US007461592B1

(12) United States Patent
Van Deusen

(10) Patent No.: US 7,461,592 B1
(45) Date of Patent: Dec. 9, 2008

(54) WALL MOUNTED CAN CRUSHER

(76) Inventor: Colin A. Van Deusen, 3718 Pine Ave., Long Beach, CA (US) 90807-3258

( * ) Notice: Subject to any disclaimer, the term of this patent is extended or adjusted under 35 U.S.C. 154(b) by 0 days.

(21) Appl. No.: 11/772,548

(22) Filed: Jul. 2, 2007

(51) Int. Cl.
*B30B 1/00* (2006.01)
*B30B 9/32* (2006.01)

(52) U.S. Cl. ..... 100/245; 100/99; 100/215; 100/265; 100/266; 100/295; 100/902

(58) Field of Classification Search ..... 100/215, 100/226, 265, 266, 280, 295, 902, 240, 245, 100/99
See application file for complete search history.

(56) References Cited

U.S. PATENT DOCUMENTS

| | | | | | |
|---|---|---|---|---|---|
| 3,062,130 | A | | 11/1962 | Huber et al. | |
| 3,889,587 | A | * | 6/1975 | Wharton | 100/98 R |
| 4,120,190 | A | * | 10/1978 | Schlau et al. | 72/458 |
| 4,248,144 | A | * | 2/1981 | Morgan | 100/244 |
| 4,290,354 | A | * | 9/1981 | Stevens | 100/218 |
| 4,301,722 | A | | 11/1981 | Balbo et al. | |
| D268,761 | S | | 4/1983 | Brown | |
| 4,403,545 | A | | 9/1983 | Toburen et al. | |
| 4,538,459 | A | * | 9/1985 | Vandenbergh | 73/379.02 |
| 4,827,840 | A | | 5/1989 | Kane | |
| 4,962,701 | A | | 10/1990 | Stralow | |
| 5,090,308 | A | | 2/1992 | Wang | |
| 5,456,166 | A | | 10/1995 | Belongia et al. | |

* cited by examiner

*Primary Examiner*—Jimmy T Nguyen
(74) *Attorney, Agent, or Firm*—Fulwider Patton LLP

(57) ABSTRACT

A wall mountable can crushing apparatus for self-feeding and rapidly repeating manual crushing of beverage cans or the like through user striking includes a housing section for feeding cans through a chute and detaining cans in a crush chamber before crushing. A punch pad for receiving the user strikes is attached to a movable portion carrying a crush piston from a retracted position into a crush position driven into contact with a can in a crush chamber. The piston is biased to be returned to the retracted position after a can is crushed and a discharge allows a crushed can to freefall out of the apparatus. Novelty features such as a pressure activated sound card or advertising mounts may be added to the can crusher for promotional appeal.

18 Claims, 7 Drawing Sheets

WALL MOUNTED CAN CRUSHER

BACKGROUND OF THE INVENTION

1. Field of the Invention

The invention relates to crushing of aluminum cans for recycling.

2. Description of the Prior Art

Landfills are fast filling up. In recognition of this fact, recyclable products such as aluminum cans have become popular in the beverage industry. The disposable of such cans has become a tremendous problem because of the bulk and inconvenience in the collection and return of such cans to a recycling station.

It is recognized that canned beverage consumption can quickly amass a stockpile of empty cans in a consumer's home, garage or recycle bin. The home-based consumer will typically enjoy the beverage from a recyclable can but not the chore of disposing the empty cans. The task of crushing beverage cans for transport or for disposal in the recycling bin can be a time consuming task, especially in those homes where canned beverages are the drinks of choice. In some households, beverages will be consumed while watching television entertainment such as sporting events or during group activities on the patio or in family dens or recreation rooms. It is not uncommon for some sports enthusiasts to consume several canned beverages in one sitting or over the weekend, especially while hosting company. The chore of preparing the cans for recycling can be tedious, time consuming and may even involve risk of injury. Cylindrical cans may be subjected to high axial forces as by impact to smash the cans to a flattened state or by gradual compression as by a device affording a mechanical advantage as by levers or hydraulic pistons.

An early technique for recycle was for a user to stomp his or her foot on an upright can and to apply a high impact force in hopes it would crush axially without sideways tipping which can lead to ankle or foot injury.

To overcome the risks and inconvenience of manually crushing individual cans early mechanical crushing devices were proposed included a vertically oriented cylindrical can chamber with a weighted metal crushing piston and extended handle. The handle was intended to lift the piston clear of the chamber for receipt of can to be crushed. These crushers suffered from their intrinsically slow and cumbersome operation.

Other solutions proposed a can crushing apparatus with a horizontal crush chamber aligned with a lever driven piston. One example representative of this solution can be seen in U.S. Pat. No. 4,301,722 to Balbo et al. A can crusher of this type is relatively unwieldy requiring considerable space for installation and clearance for the lever handle.

Others have proposed hoppers for receiving stacked cans to be fed one at a time into a crush chamber. Some examples in the prior art can be seen in U.S. Pat. Nos. 5,090,308 to Wang; 4,403,545 to Toburen et al.; 4,827,840 to Kane; and 4,962,701 to Stralow. While facilitating the storage and feed process of cans into a crushing position, these crushers also suffer from the shortcoming that elongated hand operated levers are typically relatively long thus requiring considerable clearance around the device for activation of the lever.

Other can crushers remove the manual operation altogether by electronically driving a crushing piston by a hydraulic motor as proposed in U.S. Pat. Nos. 3,062,130 to Huber et al. and 5,456,166 to Belognia et al. These machines are expensive to make and can be undesirably noisy.

It will also be appreciated that consumers, especially of alcoholic beverages, who congregate to watch sports often decorate their entertainment halls or recreation rooms with athletic team logos or marks promoting their favorite drinks, sometimes adorning their walls with novelty items such as wet bar mirrors and neon signage, that display the brand of their favorite beverage or snack. Those skilled recognize that promotional items in the home can be very influential in the purchasing habits of beverage consumers. Some of these consumers are as loyal to their brand of beverage as they are to their favorite sports team. While watching sports or engaging in group activities such as billiards, cards, etc., the fervor of these consumers may become heightened during an extended social engagement, especially after a successful play or during frustrating or disappointing periods in a game or during social discourses filled with bombast leaving some participants with pent up emotions seeking an acceptable explosive release.

What has been missing is an acceptable mechanism allowing for a socially acceptable release of such pent up emotions, particularly when such mechanism serves the redeeming purpose of also crushing recyclable empty cans that may be generated during an extended social engagement. Such a device would be a particularly interest to those with a bent on pugilistic or martial arts skills and interested in maintaining or honing their crisp striking strokes.

SUMMARY OF THE INVENTION

The present invention provides an interactive can crushing apparatus incorporating an articulated housing or frame for facilitating reciprocation of a crush piston in a crush chamber in response to striking of a punch pad.

In one embodiment, a back section and front wall include respective sets of tubular peripheral walls formed to slidably interfit. As the punch pad is struck, the piston is carried by the front wall into the crush chamber set. The front section returns to a retracted or extended position through biasing means.

The can crusher may include a number of other features some users may find desirable. For instance, a feed chute may be formed on one side with a tooth to crease the wall of the cans as they are fed down the chute to weaken them along scarring lines. The can crusher may also include advertising mounts for interchangeable placement of promotional items. In addition, as a novelty item or other means for promotion, the crusher may include an audio device activated by operation of the can crusher.

Other features and advantages of the invention will become apparent from the following detailed description, taken in conjunction with the accompanying drawings which illustrate, by way of example, the features of the invention.

DETAILED DESCRIPTION OF THE PREFERRED EMBODIMENTS

Figure 1:
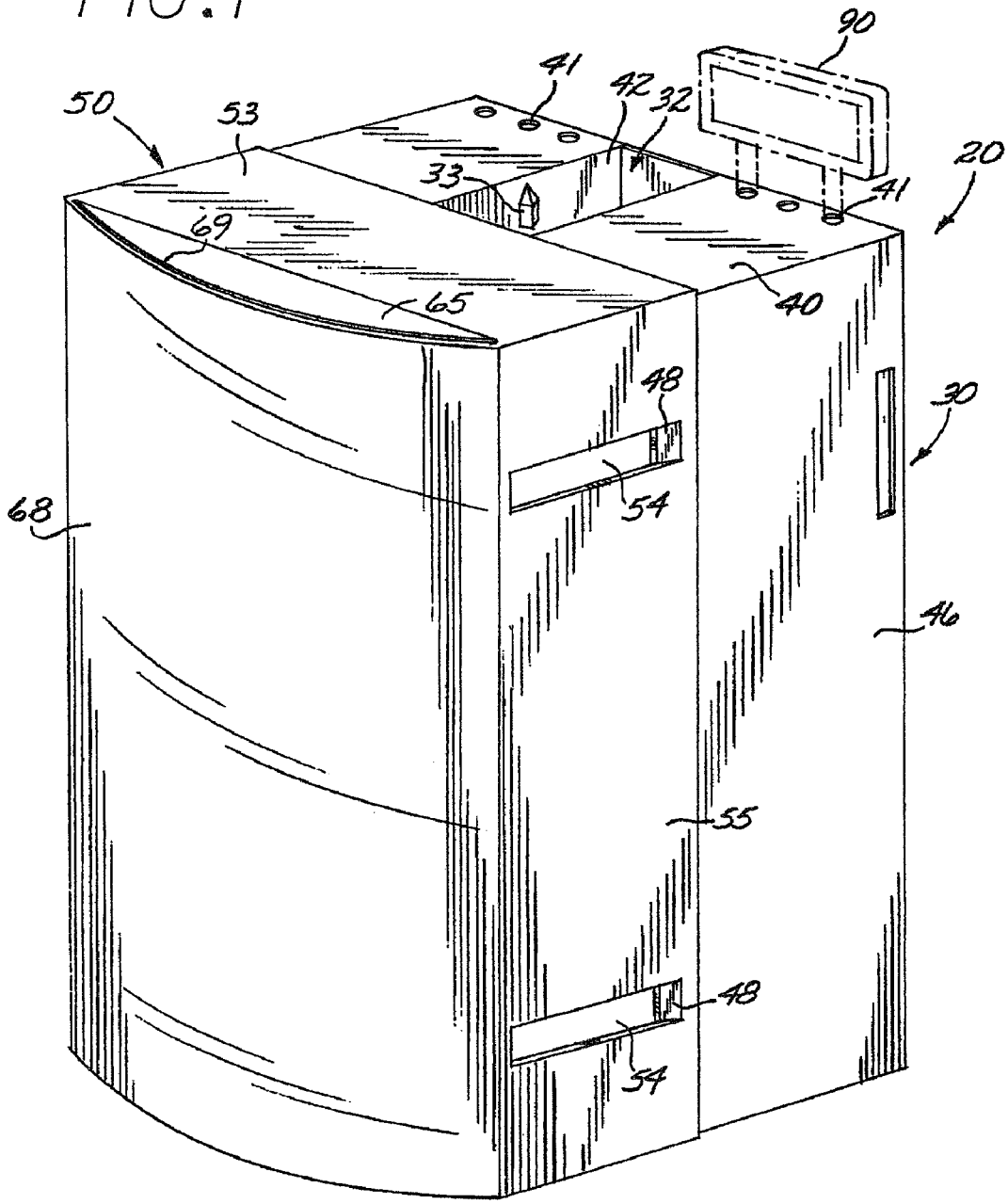
FIG. 1 is a perspective view of a wall mounted can crusher embodying the present invention.
Figure 2:
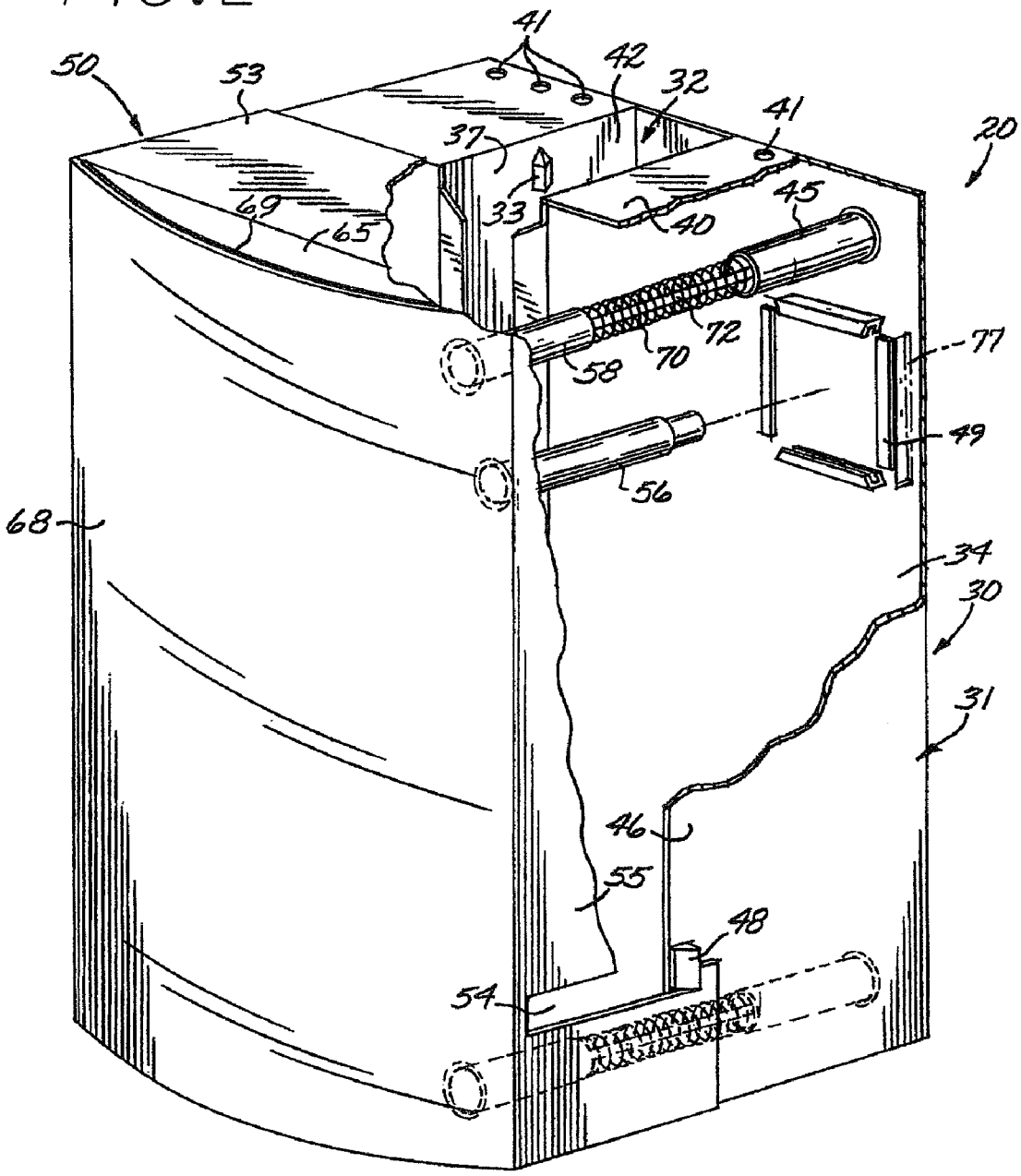
FIG. 2 is a perspective view similar to FIG. 1, partially broken away, to depict the interior of the can crusher.

Referring to FIGS. 1 and 2, the preferred embodiment of the can crusher 20 of the present invention includes first and second frames which may be in the form of a box shaped back 31 and cover 50 sections having interfitting telescopical tubular walls to be telescoped from an extended to a collapsed crushing position. The back section includes a horizontally extending forwardly opening semi-cylindrical crush chamber 36 and the cover section 50 includes a horizontal rearwardly projecting cylindrical piston 60 aligned with the crush chamber to be driven thereto when the cover is driven to its retracted position.

The back section 31 is rectangularly shaped, formed with a back wall and forwardly projecting top, bottom and sidewalls 40, 44 and 46, respectively, cooperating to form a rectangular in vertical cross section horizontally projecting tube section. Arrayed in a rectangular pattern on the back wall are forwardly projecting posts defined by open ended tubes 45 (FIG. 2).

Suspended from the back wall is the open top vertical chute 32 formed by laterally spaced apart, vertical sidewalls formed at their front extremities with in-turned, forwardly angled retainer flanges 35 and 37 and, at the lower extremity curving inwardly toward one another to form, a semi-cylindrical landing wall 51 cooperating to define the forwardly opening crush chamber 36.

Figure 3:
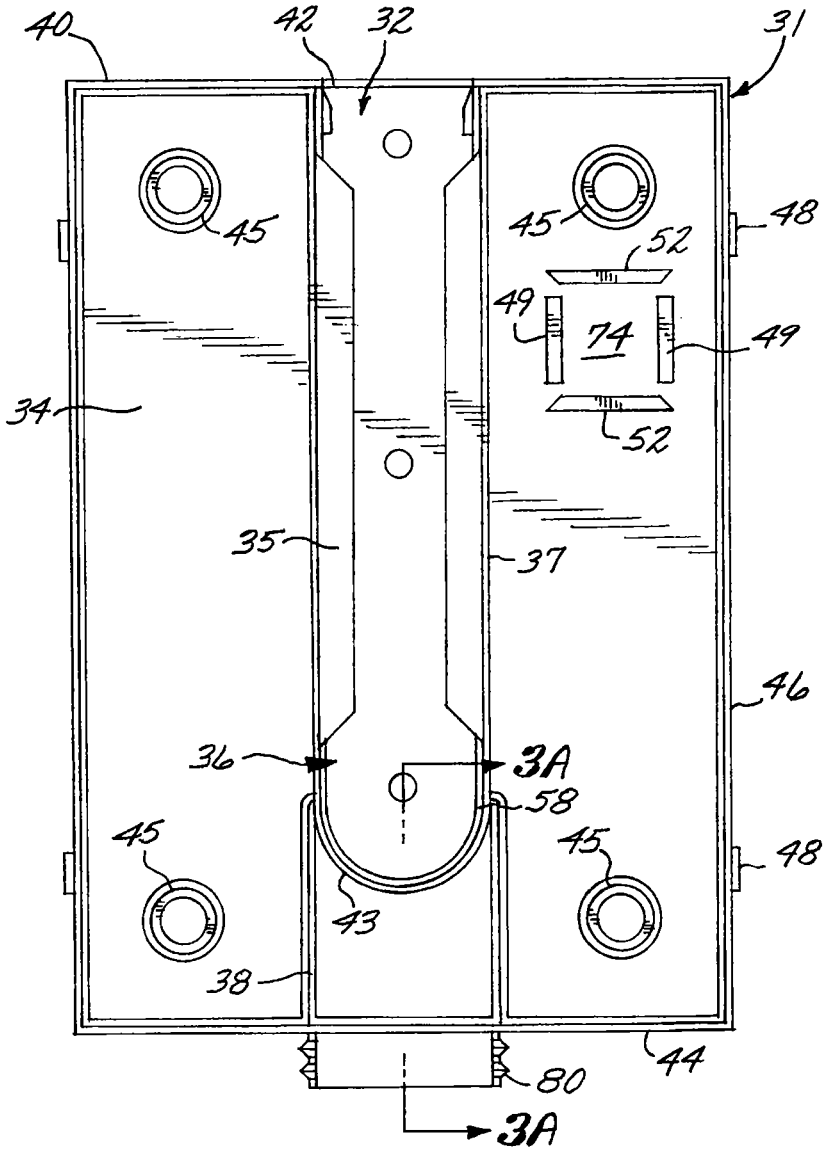
FIG. 3 is a front view in reduced scale of the back section of the can crusher shown in FIG. 1.
Figure 3A:
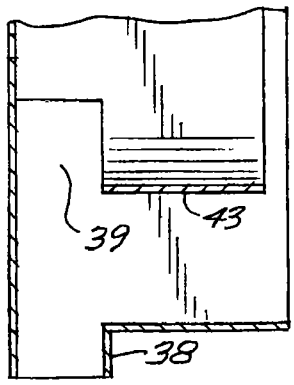
FIG. 3A is a vertical sectional view taken along the lines 3-3 of FIG. 3.
Figure 4:
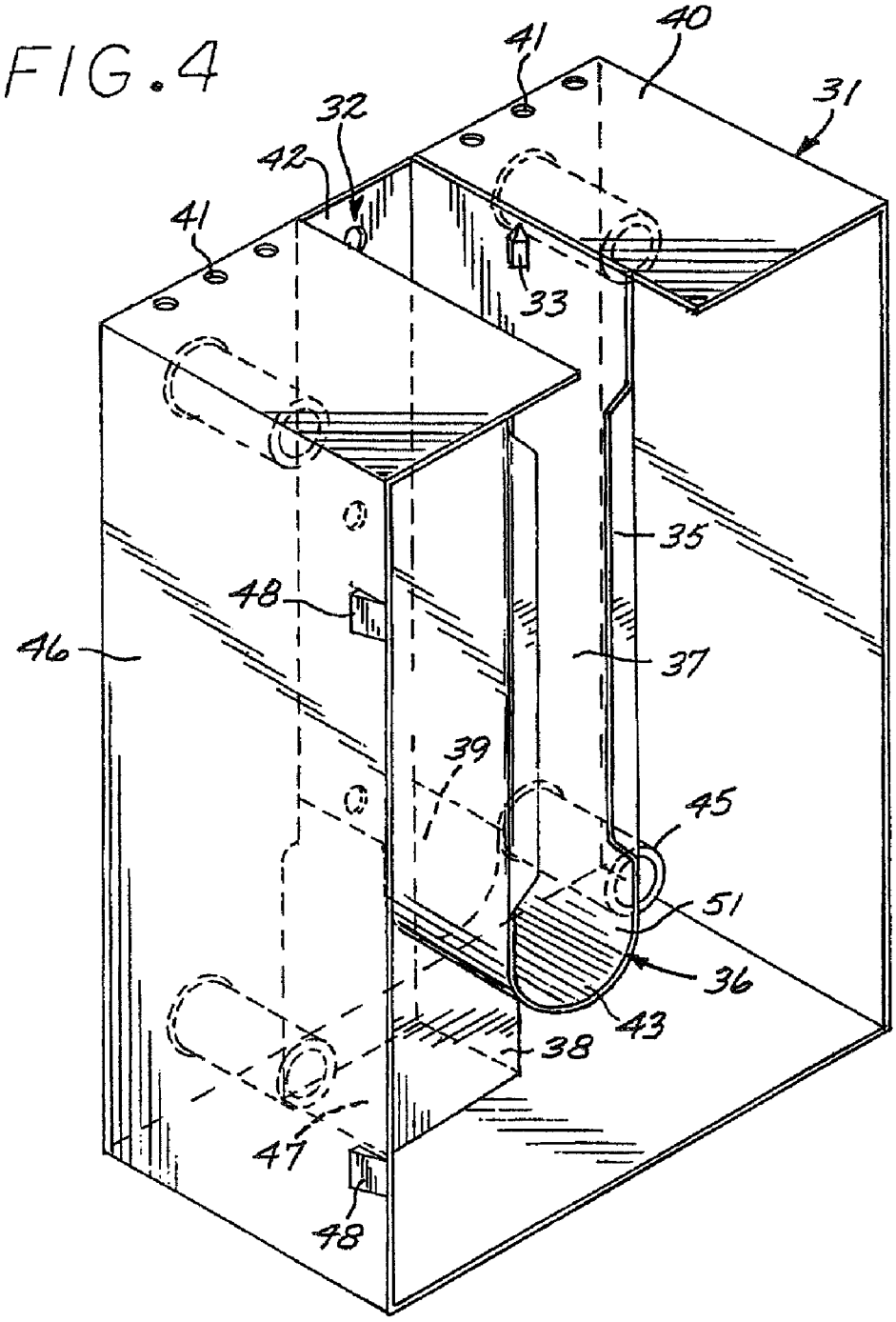
FIG. 4 is a front perspective view of the back section shown in FIG. 3.
Figure 5:
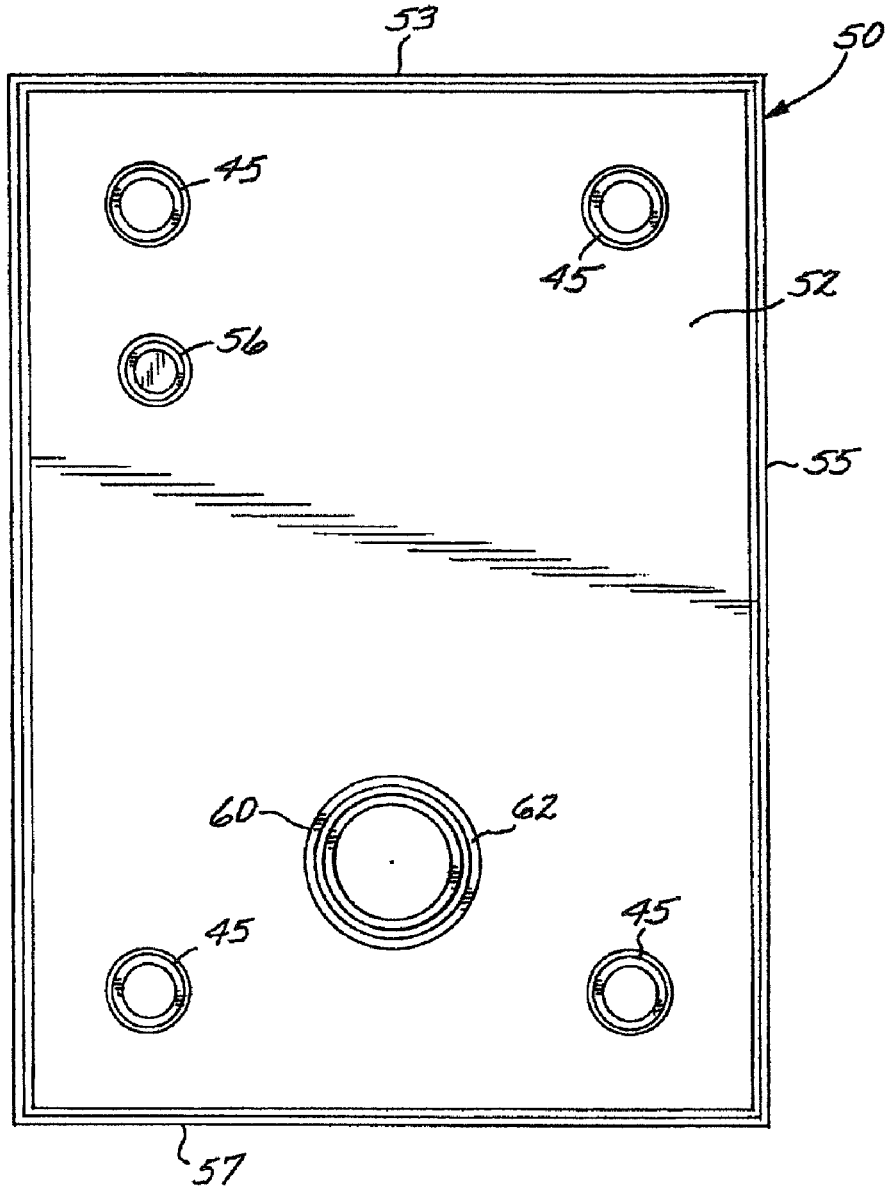
FIG. 5 is a vertical sectional, in reduced scale, taken through the front section of the can crusher shown in FIG. 1.

The curved landing wall 43 terminates at its rear extremity in an edge 44 spaced a predetermined distance from the surface of the back wall to form a downwardly opening discharge slot 39 (FIG. 3A). Mounted below the discharge slot 39 is a vertically extending discharge slide 38 for directing crushed cans from the crushing chamber to a collection bag or other container to be suspended below the crusher. Formed at the bottom extremity of the slide 38 is a neck 47 formed on its exterior surface with longitudinally spaced apart retainer ribs (FIG. 3). Mounted to the inner surface of one or both side walls of the chute 42 is a triangularly shaped scaring tooth 33 spaced from the opposite side wall of the chute to cooperate in providing a vertical path there past which is narrower than the diameter of the cans to be crushed to thereby impose a crease or wrinkle in the sidewall of the cans as they are pressed downwardly there past in the chute.

Referring to FIG. 1, the top wall 40 is formed centrally with a rectangular inlet opening 42 aligned with the chute 32 for receipt of empty cans. The top wall 40 is further formed with a plurality of horizontally spaced apart open bores 41 for frictional receipt of stems of an advertisement or promotional stand 90 which may display promotional logos or the like. It will be appreciated that the number of holes may vary or that the mount may take many different forms, such as screw thread or snap attachments.

Figure 7:
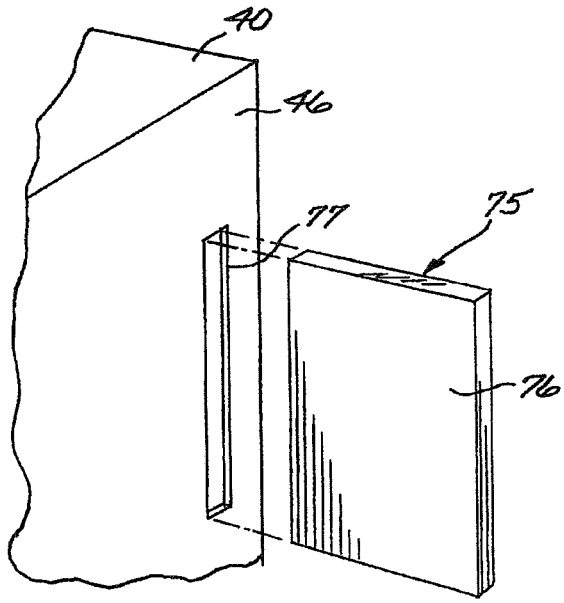
FIG. 7 is a partial perspective view, in enlarged scale, of the can crusher shown in FIG. 1.
Figure 8:
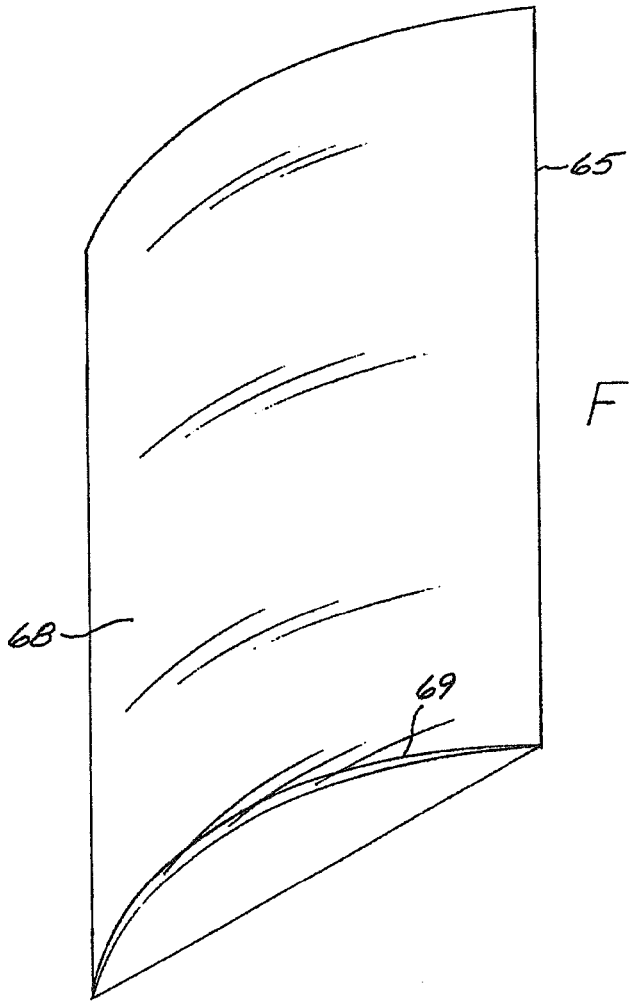
FIG. 8 is a perspective view, in reduced scale, of a punch pad employed in the can crusher shown in FIG. 1.

Mounted forwardly on the outside surfaces of the side walls 46 are vertically spaced apart triangular teeth defining slides 48 having forwardly and outwardly sloped ramp surfaces. Referring to FIGS. 2 and 3, mounted interiorly of the upper right portion of the back wall is an audio card holder formed by upper and lower spaced apart confronting channel 52 to form therebetween a card path 74 having vertical registration strips 49 on the opposite sides thereof for removable receipt of an audio card 75 (FIG. 7). In other embodiments, the card may be received bodily into a mount from the front side to be removably held in place.

Figure 6:
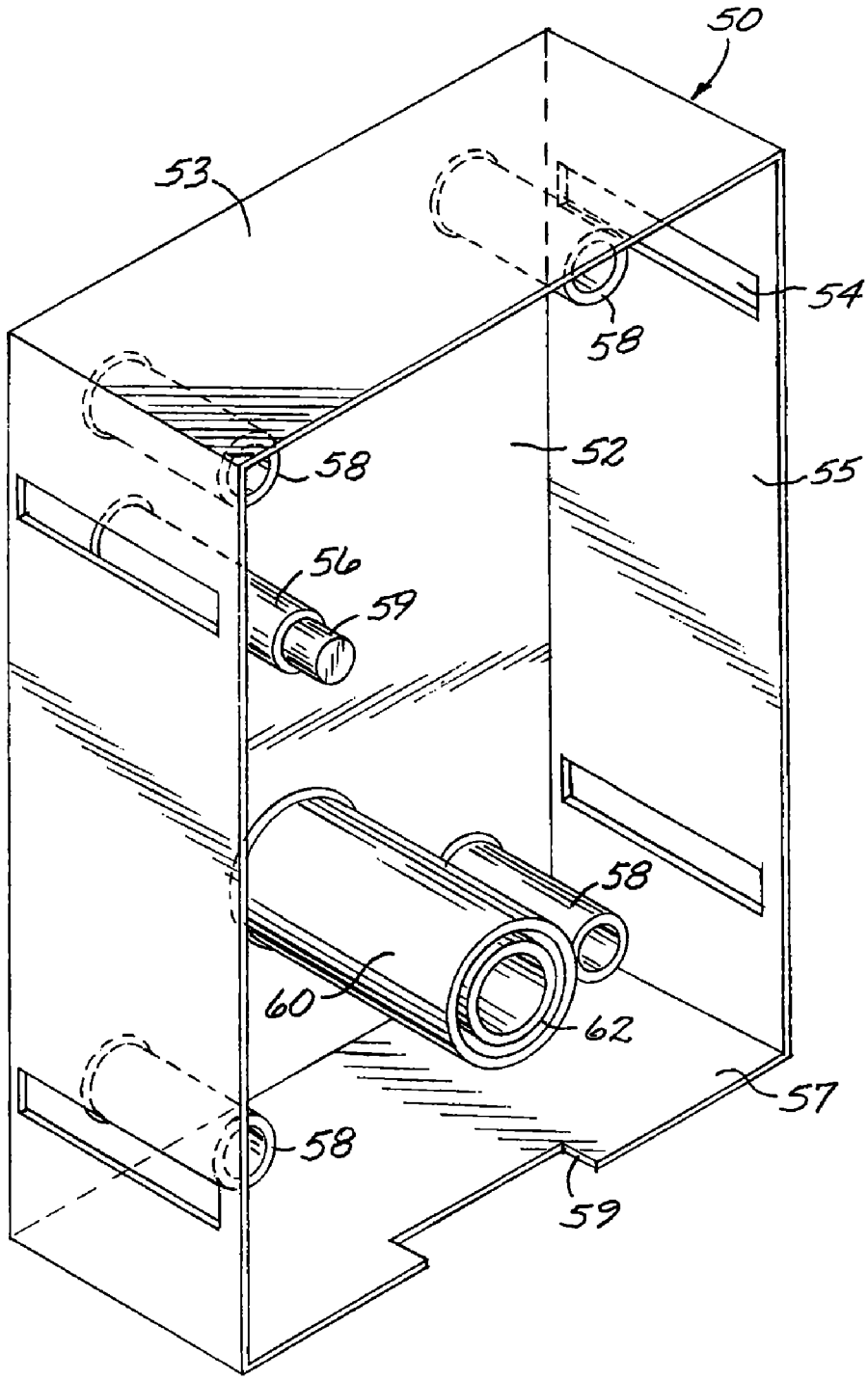
FIG. 6 is a back perspective view, in enlarged scale, of the can crusher shown in FIG. 1.

The cover section 50 is also box shaped and formed with an opaque front wall 52, top and bottom walls 53 and 57 and sidewalls and 55 (FIG. 6) cooperating to form a rectangular in vertical plan tube section shaped to compliment the tubular peripheral walls of the back section to be received in female relationship thereover. The horizontal piston 60 is conveniently suspended from the front wall 62 and is formed with concentric tubes including an inner tube 52 to cooperate together in forming a structurally sound piston. In this preferred embodiment, the piston is rigidly mounted to the front wall 52. It will be appreciated by those skilled in the art, however, that in some embodiments the piston will reciprocate through a bore in the front wall 52.

My invention is illustrated with the side walls 55 formed with horizontally elongated slide slots 54 spaced vertically apart and configured to slidably receive the respective sliders 48 to sliding there over. As will be appreciated, the slots 54 may be formed open as shown or formed as blind slots or in some instances, covered by channel shaped guards to protect against access by fingers of onlookers to avoid injury.

Mounted in a square array on the back surface of the front wall 52 are rearwardly projecting, posts which may be defined by tubes 58 axially aligned with the tubes 45 on the back wall received in the respective tubes 58 and 45 are respective coil compression springs 70 to function in maintaining the cover and back section biased apart. In the preferred embodiment, I incorporate a guide spindle 72 which may act to support the spring 70 but is of sufficient length to allow the cover to be compressed toward the back wall.

In other preferred embodiments, I incorporate reduced in diameter short alignment stems on the free extremities of the respective posts 45 and 58 over which the opposite ends of compression springs are telescoped to sandwich the springs in alignment between the posts urging the cover away from the back section.

As will be appreciated by those skilled in the art, many different biasing arrangements are known for causing the cover section to return to its extended position after being driven into its crushing relationship compressed against the back section. Such arrangements include configuring the slider slots 54 to angle upwardly and rearwardly and constructing the sliders 48 of low friction material such that the weight of the cover device itself will tend to cause the cover slide downwardly and forwardly under its own weight. In those instances, the crush chamber and piston may be angled upwardly and rearwardly at a complementally inclined angle. In other configurations, a spring biased cam is provided to urge the cover device forwardly relative to the rear section and in still other configurations the cover section 50 is configured in the form a plate suspended from the rear section by means of a parallelogrammatic linkage such that its own weight tends to shift the cover plate downwardly and forwardly, weight which may readily be overcome by the application of impact forces to the punch pad 65. In these configurations, the clearance between the free end of the piston 60 and crush chamber may be such as to accommodate the relative movement of the cover section or, possibly angled at a complementary angle to accommodate the afford described travel of the cover plate.

Also mounted to the inside surface of the front cover is a rearwardly projecting, horizontal actuator post 56. Mounting on the free extremity thereof is a resilient actuator plunger 59 disposed in horizontal alignment with the audio card path 74 for, upon the cover being depressed toward the back section, engage the front surface 76 of a pressure sensitive audio card 75 (FIG. 7) mounted between the channel 52 and 50 (FIG. 3). The bottom wall 57 is formed at its rear edge with a clearance slot 59 aligned with the discharge slide 38.

Mounted to the front surface of the cover device 50 is a punch pad device 65 including an arcuate in transverse cross section front surface 68. In the preferred embodiment, the punch pad 65 is constructed of closed cell foam material configured with a tough exterior layer encasing the foam and having a generally planer rear surface and transversely curved front surface to provide a thickened central area aligned in vertical alignment with the piston. Preferably, the punch pad device includes over the front surface thereof a flexible vinyl window cooperating to form an upwardly opening slot 69 for receipt of flexible inserts bearing advertising indicia, targets or the like to be displayed toward the user.

As will be appreciated by those skilled in the art, the punch pad 65 may be connected directly to and in alignment with the piston as shown or may be connected by mechanical linkages or gears as well known to the those so skilled.

In practice, it will be appreciated that the can crusher of the present invention is relatively economical to manufacture and can easily be assembled by merely telescoping the cover device 50 over the back section 31 allowing the tubular sidewalls 55 of the cover device to flex laterally outwardly and the sidewalls of the back section 31 to flex slightly inwardly. As the forwardly and outwardly flared ramp surfaces of the slides 48 (FIG. 1) ride forwardly on the inside surfaces of the respective side walls 55 they will register into snap respective slots 54 to be held slidingly in place. An audio card 75 (FIG. 7) may be inserted in through the slot 77 to be nested in the path 74 (FIG. 3) with the pressure sensitive surface 76 in alignment with the actuator rod 56. In other embodiments, the card will be merely slide into place from the front side of a mount.

In making the assembly, it will be appreciated that the springs 70 can be interposed between the ends of the tubes 45 and 58 (FIG. 2) to be held in place by reduced in diameter stubs at the free ends of the respective rods or possibly by the alignment rod 72 as shown.

The relatively compact can crusher may be mounted in numerous different selected areas, such as in a private recreation room, kitchen hallway or other relatively confined area or in a public sports bar or restaurant easily accessible by the patrons. It will be appreciated that for different locations and applications, different advertisements or messages may be inserted in the slot 69 to be disposed on the punch pad 65 to display selected different graphics. Other preferred logos and messages may be displayed on one or more display screens 90 (FIG. 1) mounted atop the rear section 31. A selected audio card 75 may be inserted into the slot 77 to, upon actuation, broadcast a sports related message, punch count, or other audio output associated with the particular location or possibly relating to the team loyalties of the participants joining in the group who might be using the can crusher.

As various cans are emptied, they may be drained and inserted sideways downwardly through the top opening 42 to fall down in the chute 32 landing against the semi-circular landing surface 43 and to thereafter be stacked in stacked relation in the chute. It will be appreciated that as the cans are inserted through the opening 42 they will pass downwardly past the scaring tooth 33 to cause the sidewall of the can to be driven slightly radially inwardly along a wrinkle or crease to thus provide a pre-weakened area which may facilitate the crushing action to subsequently take place.

When the chute has been fully or partially filled a user will have the opportunity to strike the punch pad 65 with, for instance, the heel of the hand, closed fist or martial arts style of strike to apply an impact force which will drive the cover section rearwardly against the force of the compression springs 70 thereby driving the piston rearwardly into the end wall of the can nested against the landing surface 43 in the chamber 36 to drive the end of the can toward the opposite end abutted against the back wall so as to impart a relatively high kinetic energy to the piston tending to overcome the axial or column strength of the sidewalls of the can so as to crumple such sidewalls as the impacted end is driven toward the abutted end of the can thus crushing the can to a sufficiently short length equal to or less than the horizontal width of the discharge slot. During such retraction the slide slots serve to maintain the cover section in horizontal alignment as they travel rearwardly on the slides 48. Then, as the cover section recovers from the impact, the compression springs 70 will drive the cover device to the extended position shown in FIG. 2, causing the piston to be retracted from the crushed can leaving it free to fall downwardly in the discharge slot through the slide 38 to be collected in a bag or other container attached to the neck 47 (FIG. 3).

As will be appreciated by those skilled in the art, in some embodiments the crush chamber will be carried by the back frame as shown in this embodiment while the front section will carry the chamber and the piston will be carried by the frame defining the back section.

It will be appreciated that as the cover section is driven rearwardly to crush the can, the actuation post 56 (FIG. 2) will be driven rearwardly to allow the actuation stem to engage the front surface 76 audio card to actuate such audio card 75 and play the message pre-recorded thereon.

It will be appreciated that this crushing action may be repeated either as individual cans are inserted in the chute or as a stack of cans in the chute fall sequentially downwardly into the crush chamber. That is, once the piston 60 is retracted from the crush chamber, the next can in order will be free to fall down into the crush chamber 36 ready for a repeated action.

The user may thus, if desired, rapidly repeat a crushing strike against the punch pad 65 to quickly and repeatedly to actuate the piston to perform the above described crushing action to thus rapidly dispose of the uncrushed cans and possibly experience an adrenalin rush.

From the foregoing, it will be appreciated that the can crusher of the present invention is relatively economical to manufacture and use. It is relatively compact for mounting in restricted areas and requires only minimal clearance thereabout for actuation of the blow for striking against the pad to drive the piston against the can in the crush chamber. The overall arrangement and layout provides for a relatively pleasing experience for the user and exposes him or her to the advertisements, promotions, logos or targets received in the slot 69 of the pad and the logos and promotion messages on the screen 90.

I claim:

1. Can crushing apparatus for crushing a can from a predetermined configuration having a side profile to a reduced configuration, comprising:

a housing including a back section for mounting to structural wall and a cover section complementally shaped to receive the back section therein;

a crush chamber on the back section for receiving the can and including a bottom wall formed with a discharge opening having horizontal cross section smaller than the side profile of the can and configured to pass the can in the reduced configuration;

a piston is rigidly mounted to a front wall of the cover section, the piston including a driving end and a working end aligned with the chamber and reciprocable from a retracted position to a crushing position projecting into the chamber to, upon shifting to the crushing position, contact a can in the chamber to crush it to the reduced configuration to fit through the discharge opening; and a punch pad extending over a front surface of the front wall of the cover section, the punch pad to be struck directly by a user to drive the piston from the retracted position to the crushing position.

2. The can crushing apparatus of claim 1 wherein:

the cover and back sections are constructed with peripheral walls slidably fitted together; and the piston is carried from the front wall to be, upon the front wall being driven from the retracted position to the crushing position, drive the piston into the chamber to crush the can to the reduced configuration.

3. The can crushing apparatus of claim 1 including:

means for biasing the piston to the retracted position.

4. The can crushing apparatus of claim 2, including:

at least one spring interposed between the back section and cover section biasing the cover section to the retracted position.

5. The can crushing apparatus of claim 1 that includes:

a chute leading to the chamber; and a tooth mounted to one side of the chute and spaced from the opposite side of the chute a distance less than the diameter of the can.

6. The can crushing apparatus of claim 1, further comprising:

a discharge slide connected to the discharge opening and projecting exteriorly from the housing.

7. The can crushing apparatus of claim 1, further comprising:

a holder on the back section for holding a pressure actuated audio card; and an actuator mounted on the cover section, the actuator responsive to the piston being shifted from its retracted position to its crushing position to activate the card.

8. The apparatus of claim 1 further comprising:

advertising mount carried on the housing.

9. The can crusher apparatus of claim 1 wherein:

the cover and back sections are constructed with peripheral tubular walls complementally shaped to be inter-fitted and slide relative to one another from respective retracted to crushing positions;

at least one wall of one of the sections is configured with an elongated guide; and at least one peripheral wall of the other section includes a slider received in the guide.

10. The can crusher apparatus of claim 1 that includes:

a plurality of pairs of confronting, axially aligned biased posts carried from the respective back and cover sections; and coil springs interposed between the respective pairs of posts.

11. The can crusher apparatus of claim 1 wherein:

the back and cover sections are formed with respective complementally shaped peripheral walls which are received in sliding, inter-fitting relationship for sliding from the retracted position to the crushing position and the punch pad is in the form of a compressible pad extending over the front surface of the cover section.

12. The can crushing apparatus of claim 1 that includes:

a flexible window carried over the punch pad for receiving there behind a graphic sheet.

13. The can crushing apparatus of claim 1 wherein:

the housing includes mounting means for mounting an advertising screen.

14. The can crushing apparatus of claim 1 that includes:

a chute mounted on the back section for conveying the can to the crush chamber.

15. Can crushing apparatus comprising:

a back section including a back wall and a back tubular peripheral wall;

a cover section including a front wall and a front tubular peripheral wall complementally shaped to receive the back tubular peripheral wall in female relationship thereover for shifting of the front wall from an extended position to a retracted crushing position;

a crush chamber mounted from the back wall, opening forwardly and configured with a bottom wall including a discharge slot;

a can chute carried from the back section for conveying cans to the crush chamber;

a guide device interposed between the cover and back sections for guiding travel of the cover section from the extended to the crushing position;

pairs of spring mounts on the respective cover and back sections;

coil compression springs interposed between the spring mounts for biasing the cover section away from the back section to the extended position; and a crush piston mounted from the cover section, projecting rearwardly to, upon the cover section being shifted from the extended to the crushing position, engage a can in the crush chamber to crush it to a crushed configuration to be ejected through the discharge slot.

16. Can crushing apparatus for crushing a can from a predetermined configuration to a reduced configuration, comprising:

a vertically elongated back section for mounting to a structural wall and a cover section complementally shaped to receive the back section therein;

a crush chamber on the back section for receiving the can and including a bottom wall formed with a discharge opening having horizontal cross section smaller than a length of the can and configured to pass the can in the reduced configuration;

a piston is rigidly mounted to a front wall of the cover section, the piston including a driving end and a working end aligned with the chamber and reciprocable from a retracted position to a crushing position projecting into the chamber to, upon shifting to the crushing position, contact a can in the chamber to crush it to the reduced configuration to fit through the discharge opening;

a punch pad extending over a front surface of the front wall of the cover section, the punch pad to be struck directly by a user to drive the piston from the retracted position to the crush position; and the back and cover sections formed with respective complementally shaped peripheral walls which are received in sliding, inter-fitting relationship for sliding of the cover section from the retracted position to the crushing position and the punch pad is in the form of a compressible pad extending over the front surface of the cover section.

17. Can crushing apparatus for crushing a can from a predetermined configuration to a reduced configuration, comprising:

a vertically elongated back section for mounting to a structural wall and a cover section complementally shaped to receive the back section therein;

a crush chamber on the back section for receiving the can and including a bottom wall formed with a discharge opening having horizontal cross section smaller than a length of the can and configured to pass the can in the reduced configuration;

a piston is rigidly mounted to a front wall of the cover section, the piston including a driving end and a working end aligned with the chamber and reciprocable from a retracted position to a crushing position projecting into the chamber to, upon shifting to the crushing position, contact a can in the chamber to crush it to the reduced configuration to fit through the discharge opening;

a punch pad extending over a front surface of the front wall of the cover section, the punch pad to be struck directly by a user to drive the piston from the retracted position to the crush position;

the cover and back sections constructed with peripheral walls slidably fitted together to shift from the retracted position to the crushing position; and wherein the piston is carried from cover section to be, upon the cover section being driven from the retracted position to the crushing position, drive the piston into the crush chamber.

18. Can crushing apparatus for crushing a can from a predetermined configuration to a reduced configuration, comprising:

a vertically elongated back section for mounting to a structural wall and a cover section complementally shaped to receive the back section therein;

a crush chamber on the back section for receiving the can and including a bottom wall formed with a discharge opening having horizontal cross section smaller than a length of the can and configured to pass the can in the reduced configuration;

a piston is rigidly mounted to a front wall of the cover section, the piston including a driving end and a working end aligned with the chamber and reciprocable from a retracted position to a crushing position projecting into the chamber to, upon shifting to the crushing position, contact a can in the chamber to crush it to the reduced configuration to fit through the discharge opening;

a punch pad extending over a front surface of the front wall of the cover section, the punch pad to be struck directly by a user to drive the piston from the retracted position to the crush position;

a holder on the back section for holding a pressure actuated audio card; and an actuator mounted on the cover section, the actuator responsive to the piston being shifted from its retracted position to its crushing position to activate the card.

* * * * *

UNITED STATES PATENT AND TRADEMARK OFFICE

CERTIFICATE OF CORRECTION

PATENT NO. : 7,461,592 B2
APPLICATION NO. : 11/772548
DATED : December 9, 2008
INVENTOR(S) : Colin A. Van Deusen It is certified that error appears in the above-identified patent and that said Letters Patent is hereby corrected as shown below:

Column 4,
line 7, after "sidewalls" delete "and".
line 11, after "wall" delete "62" and insert --52--.
line 12, after "tube" delete "52" and insert --62--.

Signed and Sealed this

Twenty-second Day of December, 2009

David J. Kappos

David J. Kappos
*Director of the United States Patent and Trademark Office*